United States Patent [19]

Fomichev et al.

[11] Patent Number: 4,671,092

[45] Date of Patent: Jun. 9, 1987

[54] METHOD AND APPARATUS FOR HOT ROLLING OF BEVEL GEARS

[75] Inventors: Leonid F. Fomichev; Alexandr M. Gorokhovsky; Nikolai A. Romashikhin, all of Moscow, U.S.S.R.

[73] Assignee: Nauchno-Issledovatelsky Institut Tekhnologii Avtomobilnoi Promyshlennosti, Moscow, U.S.S.R.

[21] Appl. No.: 745,841

[22] Filed: Jun. 17, 1985

[30] Foreign Application Priority Data

Sep. 20, 1984 [SU] U.S.S.R. ..... 3792250

[51] Int. Cl.[4] ..... B21H 5/04

[52] U.S. Cl. ..... 72/102; 72/84; 72/125; 72/444

[58] Field of Search ..... 29/159.2; 72/69, 84, 72/85, 101, 102, 105, 109, 125, 444

[56] References Cited

U.S. PATENT DOCUMENTS

| | | | |
|---|---|---|---|
| 1,001,799 | 8/1911 | Anderson | 72/102 |
| 3,078,745 | 2/1963 | Erdelyi | 72/69 |
| 3,695,078 | 10/1972 | Bruinsma | 72/102 |

FOREIGN PATENT DOCUMENTS

| | | | |
|---|---|---|---|
| 275995 | 7/1980 | U.S.S.R. | 72/69 |
| 753521 | 8/1980 | U.S.S.R. | 72/69 |

*Primary Examiner*—Lowell A. Larson

*Attorney, Agent, or Firm*—McAulay, Fields, Fisher, Goldstein & Nissen

[57] ABSTRACT

A method for hot rolling of bevel gears by infeeding a rotating gear rolling die having a synchronizing member into a rotating work gear having a synchronizing member. First, the teeth of the synchronizing members are brought into engagement, and then rough forming of teeth on the work gear takes place under the action of the teeth of the gear rolling die, wherein the synchronizing member of the work gear is acting as the driving member, and finish rolling of the rolled teeth of the work gear takes place, with the rotating gear rolling die acting as the driving member.

An apparatus for carrying out the above method for hot rolling of bevel gears includes a work gear spindle having its power rotation drive and a gear rolling die spindle having power drives for its rotation and axial movement, the spindles being installed in the bed at an angle with respect to each other. There is also provided a power distribution unit connected to the power drives for rotating the gear rolling die spindle and work gear spindle, respectively.

6 Claims, 8 Drawing Figures

METHOD AND APPARATUS FOR HOT ROLLING OF BEVEL GEARS

FIELD OF THE INVENTION

The invention relates to the press-working of metals, and more specifically, is concerned with methods and apparatus for hot rolling bevel gears.

A method and apparatus for hot rolling of bevel gears find application in the automotive, tractor and other industries where bevel gears are used in mass or large batch production.

BACKGROUND OF THE INVENTION

Already known is a method for hot rolling of bevel gears (cf. USSR Inventor's Certificate No. 275995, Cl. B 21 H 5/04, 1966), comprising infeeding a freely rotating gear rolling die with a synchronizing member into a work gear with a synchronizing member rotated by a power drive. First, the teeth of the synchronizing members are caused to mesh. The gear rolling die is thereby rotated by the work gear synchronizing member. Then the indexing forming the teeth on the work gear and the finish rolling of the teeth take place under the action of those teeth of the gear rolling die.

An apparatus for carrying out a method for hot rolling of bevel gears (cf. USSR Inventor's Certificate No. 275995, Cl. B 21 H 5/04, 1966), also is known to compare a bed, a work gear spindle having a work gear chucking means, a gear rolling die spindle having a gear rolling die secured thereto. The work gear spindle and the gear rolling die spindle are installed in the bed in an angular relationship with each other. Synchronizing members are provided on the end faces of the work gear spindle and gear rolling die spindle. The apparatus also comprises power drives for rotating the work gear spindle and for axially moving the gear rolling die spindle.

The above described method and apparatus for hot rolling of bevel gears according to the prior art involve bringing into a meshing relationship non-rotating teeth of a gear rolling die synchronizing member and the rotating teeth of a work gear synchronizing member which results in knocking and breakage of the teeth of the die and work gear synchronizing teeth. In addition, the accuracy and the quality of the rolled teeth of a gear are determined by the quality and the accuracy of the teeth of the synchronizing members of the gear rolling die and of the work gear rather than by the quality and the accuracy of the teeth of the gear rolling die. As a result, the accuracy and the quality of the rolled teeth of a gear are not high enough. Accordingly, the service life of the gear rolling die is short and amounts to only 2000–3000 rolled gears.

A method for hot rolling of bevel gears (cf. USSR Inventor's Certificate No. 753521, Cl. B 21 H 5/04, 1980), likewise is known to comprise infeeding a gear rolling die having a synchronizing member and rotated by an independent low-power drive into a work gear having a synchronizing member and rotated by a power drive. According to this method the teeth of the synchronizing members of the gear rolling die and of the work gear first are brought into a meshing relationship, and then the indexing tooth forming and finish rolling of the rolled teeth of the gear are performed under the action of the teeth of the gear rolling die.

An apparatus for carrying out a method for hot rolling of bevel gears (cf. USSR Inventor's Certificate No. 753521, Cl. B 21 H 5/04, 1980), is known to comprise a bed, a work gear spindle having a work gear chucking means and a work gear power drive. An axially movable gear rolling die spindle having a gear rolling die is installed in the bed at an angle to the work gear spindle. Synchronizing members are provided on the end faces of the work gear spindle and the gear rolling die spindle. A non-power drive for rotating the gear rolling die is provided on the gear rolling die spindle. The gear rolling die spindle is connected to the bed through an axial motion drive which comprises Euler levers and a hydraulic cylinder. In this method for hot gear rolling and in the apparatus for carrying out the method, the accuracy and quality of rolled gear teeth are determined by the accuracy and quality of synchronizing members of the spindles which act as power drive members during the indexing tooth forming on the work gear and finish rolling of rolled gear teeth, rather than by the accuracy and the quality of teeth of the gear rolling die. As a result, the accuracy and quality of rolled gear teeth are rather inadequate. Owing to differences between the teeth of the gear rolling die and of the synchronizing members of the gear rolling die and work gear spindle, the gear rolling die has a short service life which amounts to only 2000–3000 rolled gears.

OBJECT AND SUMMARY OF THE INVENTION

It is an object of the invention to improve the quality and the accuracy of rolled gear teeth and to thereby prolong the service life of a gear rolling die.

This object is accomplished by in accordance with the invention a method for hot rolling of bevel gears, comprising infeeding a rotating gear rolling die having a synchronizing member into a rotating work gear having a synchronizing member wherein first, the teeth of the synchronizing members are brought into a meshing relationship, with the subsequent indexing forming of teeth on the work gear and the finish rolling of the rolled teeth under the action of the teeth of the gear rolling die. According to the invention, the rotating synchronizing member of the work gear acts as driving member during the indexing tooth forming under the action of the gear rolling die, and the rotating gear rolling die acts as the driving member during the finish rolling of the rolled teeth.

To lower the dynamic loads on the kinematic pairs of the driving members, it is preferred that the change from the drive by the synchronizing member of the work gear to the drive by the gear rolling die be effected during the infeed of the rotating gear rolling die into the rotating work gear.

The above object is also accomplished by an apparatus for carrying out method for hot rolling of bevel gears, comprising a bed, a work gear spindle having a synchronizing member and a rotary drive thereof, and a gear rolling die spindle having a synchronizing member and a drive for rotation and axial movement thereof, wherein the spindles is installed in the bed in an angular relationship with each other, causing the rotation drive of the gear rolling die spindle by a power drive, and providing a matching unit connected to the power rotation drives of the gear rolling die spindle and work gear spindle.

To simplify the control system, improve maintenance and to reduce the size and the weight of the apparatus for carrying out the present method for hot rolling of bevel gears, it is preferred that the power drives for rotating the gear rolling die and work gear be made in the form of hydraulic motors and that a matching unit be made in the form of two controlled valves secured to the bed and installed in the hydraulic lines of the hydraulic motors and of two adjustable cams secured to the gear rolling die spindle and engageable with the controlled valves.

BRIEF DESCRIPTION OF THE DRAWINGS

The invention will now be described with reference to specific embodiments of a method and apparatus for hot rolling of bevel gears, illustrated in the accompanying drawings, in which.

DETAILED DESCRIPTION OF THE INVENTION AND ITS PREFERRED MODE

The present method for hot rolling of bevel gears will become apparent from the following detailed description of an apparatus for carrying out the method.

Figure 1:
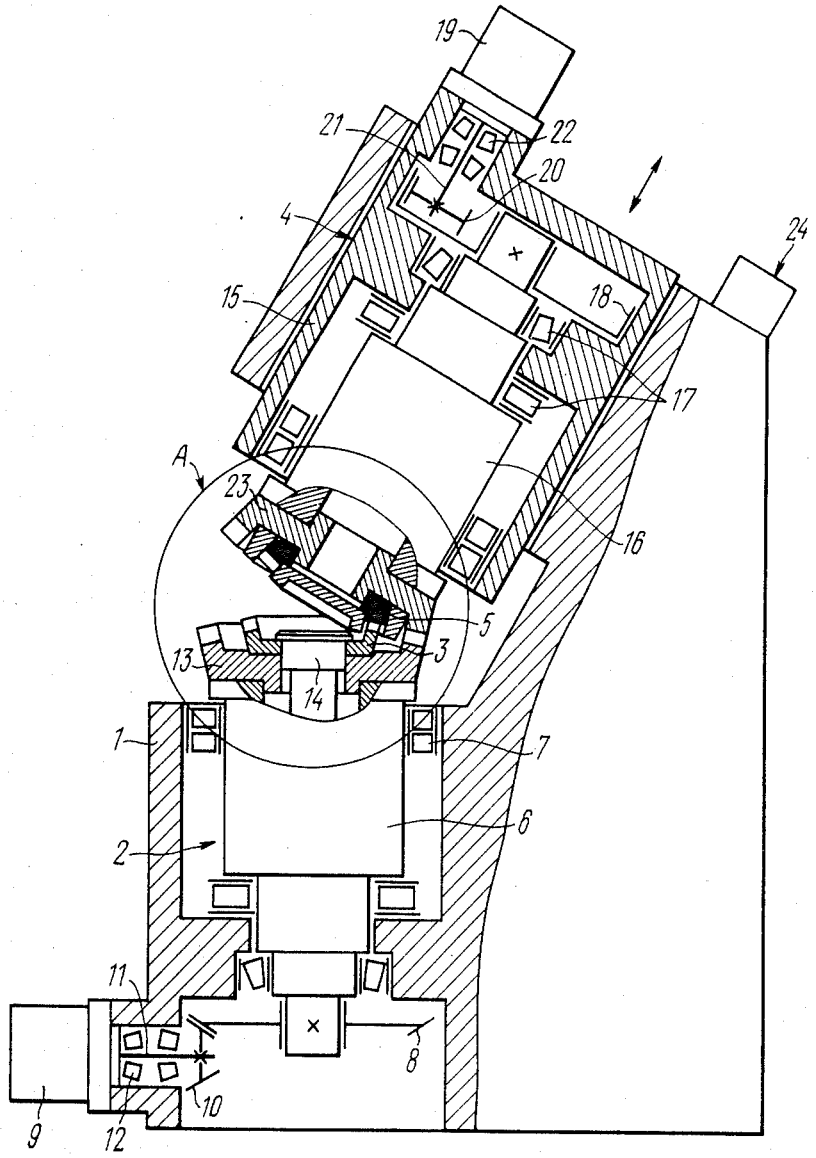
FIG. 1 is a kinematic diagram in longitudinal section of an apparatus for hot rolling of bevel gears according to the invention.

An apparatus for carrying out the method for hot rolling of bevel gears comprises a bed 1 (FIG. 1). A spindle 2 of a work gear 3 is mounted rotatably in the bed 1. A spindle 4 of a gear rolling die 5 is installed in the bed at an angle with respect to the spindle 2 of the work gear for rotation and axial movement.

The spindle 2 of the work gear comprises a shaft 6 journalled in bearings 7, a driven gear 8 secured to the shaft 6, a drive 9 in the form of a hydraulic motor secured to the bed 1, a drive gear 10 secured to a shaft 11 of the drive 9, journalled in bearings 12 and meshing with the gear 8. A synchronizing member 13 is rigidly secured to the shaft 6. A chucking means 14 for chucking the work gear is mounted in the interior of the shaft 6. The work gear 3 is mounted on the synchronizing member 13.

The spindle 4 of the gear rolling die comprises a casing 15 mounted for axial movement in the bed 1, a shaft 16 journalled in bearings 17, a driven gear 18 secured to the shaft 16, a drive 19 in the form of a hydraulic motor secured to the casing 15, a drive gear 20 secured to shaft 21 of a drive 19, journalled in bearings 22 and meshing with the gear 18. A synchronizing member 23 is rigidly secured to the shaft 16. The gear rolling die 5 is secured to the synchronizing member 23.

Figure 2:
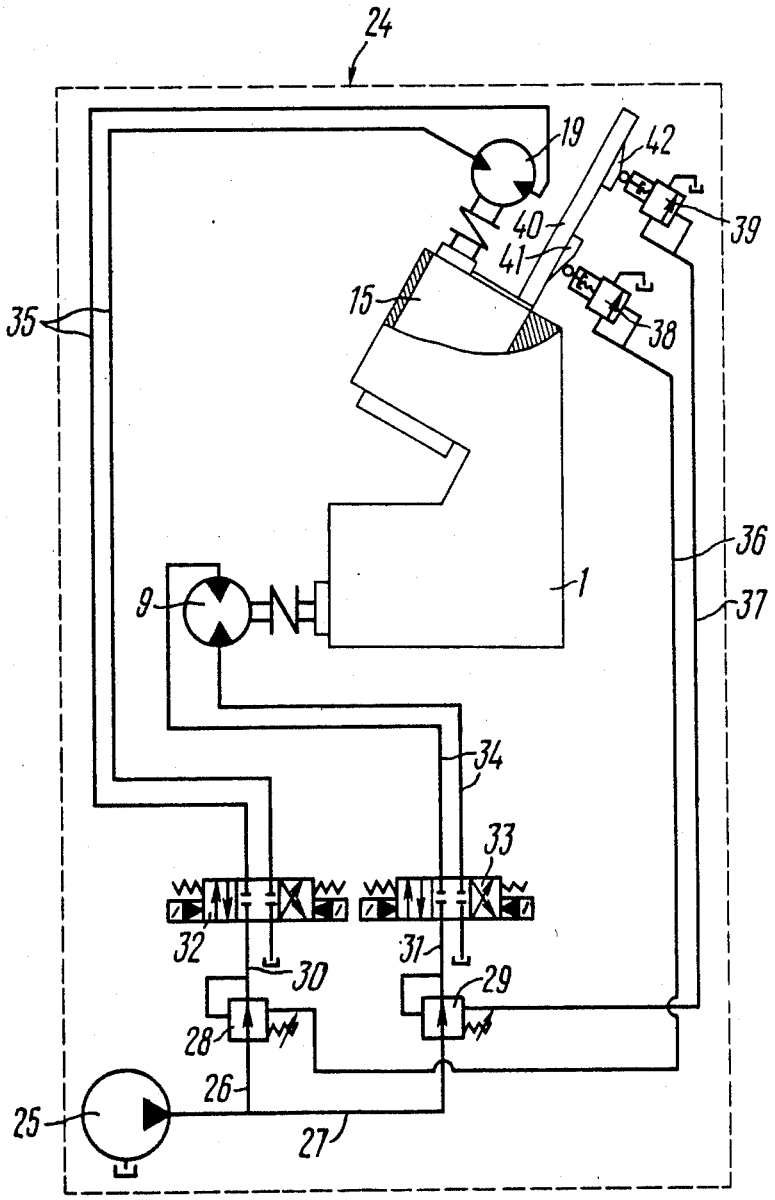
FIG. 2 is a hydraulic matching unit system according to the invention.

The apparatus of this invention also comprises a power distribution unit 24 (FIG. 2) connected to the drive 9 of the work gear spindle 2 and to the drive 19 of the gear rolling die spindle 4.

The power distribution unit 24 comprises a hydraulic pump 25 connected by means of pipelines 26, 27 to remotely controlled valves 28, 29, respectively. The valves 28, 29 are connected, by means of pipelines 30, 31, to directional valves 32, 33, respectively. The directional valves 32, 33 are connected, by means of pipelines 34, 35, to the drive 9 of the work gear spindle 2 and to the drive 19 of the gear rolling die spindle 4, respectively.

The remotly controlled reducing valves 28, 29 are connected, by means of pipelines 36, 37, respectively, to control valves 38, 39 mounted on the bed 1. An arm 40 supporting adjustable cams 41, 42 engageable with the control valves 38, 39, respectively, is installed on the casing 15 of the gear rolling die spindle 4.

The apparatus for carrying out the method of the invention for hot rolling of bevel gear functions in the following manner.

Figure 3:
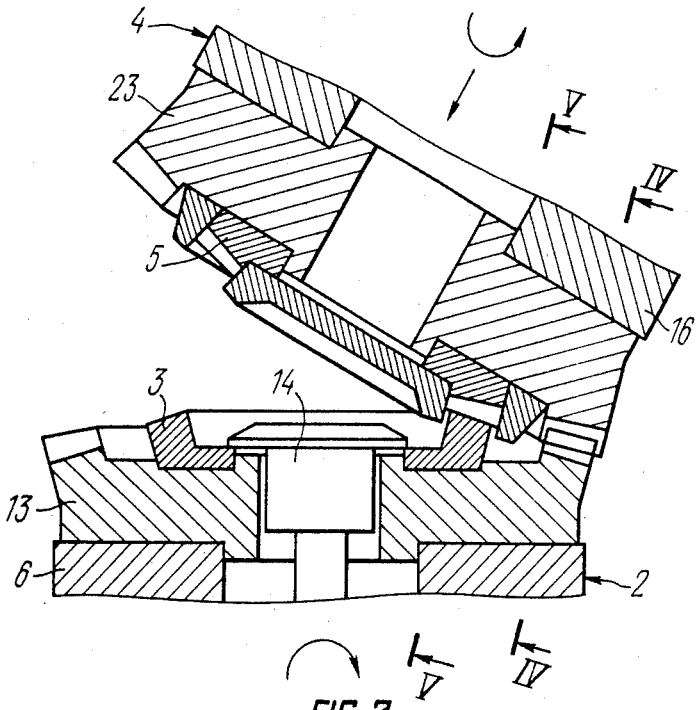
FIG. 3 is a detailed view in longitudinal section showing the zone of rolling of bevel gears during the process of rough forming according to the invention.
Figure 4:
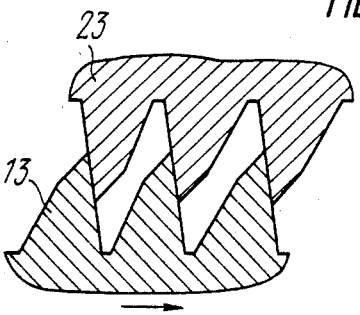
FIG. 4 shows teeth of synchronizing members of spindles of a gear rolling die and work gear in sectional view taken along line IV—IV in FIG. 3 according to the invention.
Figure 5:
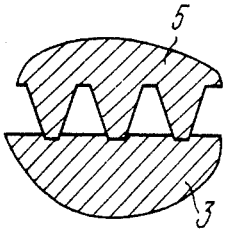
FIG. 5 shows teeth of a gear rolling die and work gear in sectional view taken along line V—V in FIG. 3, according to the invention.
Figure 6:
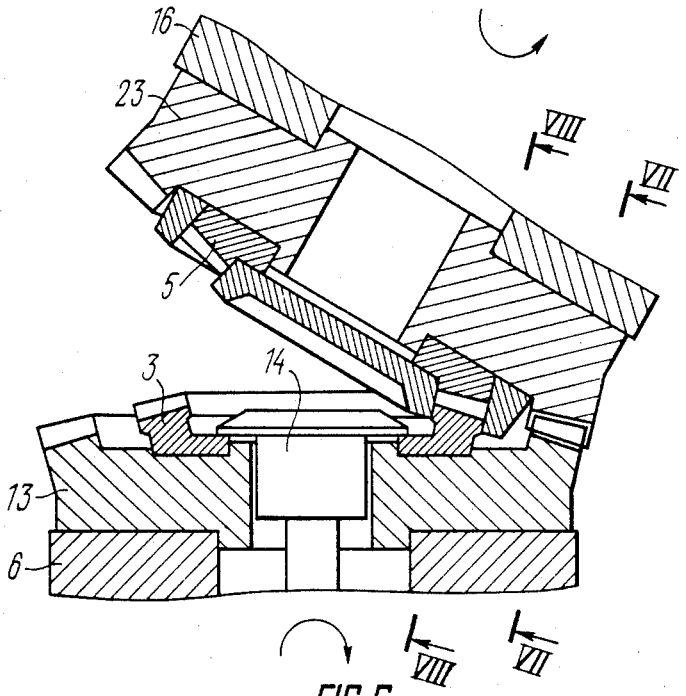
FIG. 6 is a detailed view in longitudinal section showing the zone of rolling of bevel gears during finish rolling of the rolled teeth, a longitudinal section according to the invention.
Figure 7:
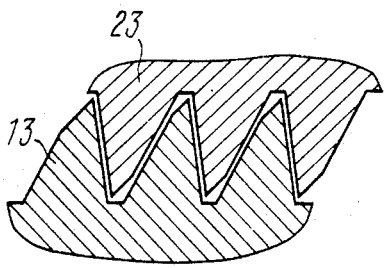
FIG. 7 shows teeth of synchronizing members of a gear rolling die and work gear in sectional view taken along line VII—VII in FIG. 6, according to the invention.
Figure 8:
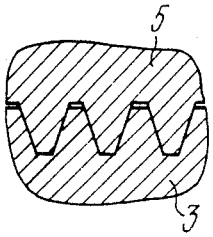
FIG. 8 shows teeth of a gear rolling die and work gear in sectional view taken along line VIII—VIII in FIG. 6, according to the invention.

The gear rolling die spindle 4 (FIG. 1) carrying the gear rolling die 5 and the synchronizing member 23 rotated by the drive 19 is moved at an angle with respect to, and toward the work gear spindle 2 carrying the work gear 3 and the synchronizing member 13 rotated by the drive 9. The work gear 3 is heated to 1150° C. and is chucked on the spindle 2 by the chucking means 14. The cams 41 and 42 (FIG. 2) engage the control valves 38, 39, respectively. The control valve 39 is fully closed by the cam 42 and the control valve 38 is released. Consequently, the control valve 39 acts through the pipeline 37 on the valve 29 causing it to increase pressure in the pipelines 31, 34 of the drive 9 of the work gear spindle 2 (FIG. 1) to the proper working value. The reducing valve 28 will establish in the pipeline 30 (FIG. 2) a minimum pressure which is necessary for the drive 19 of the gear rolling die spindle 4 to enable it rotate the gear rolling die 5 (FIG. 1) and the synchronizing member 23 at a speed which is slightly lower than the speed of the work gear spindle 2. The teeth of the synchronizing members 13 and 23 (FIG. 3) are smoothly brought in engagement, the teeth of the synchronizing member 13 (FIG. 4) rotating at a higher speed, bearing with their flanks against the teeth of the synchronizing member 23. Thus rotation of the work gear 3 (FIG. 5) and gear rolling die is synchronized and, during further movement of the gear rolling die spindle 4 (FIG. 3), rough forming of teeth on the heated work gear 3 takes place under the action of teeth of the gear rolling die 5. During this period, the rotating synchronizing member 13 of the work gear 3 acts as driving member. Subsequently, upon movement of the gear rolling die spindle 4 (FIG. 6), the teeth of the gear rolling die 5 are feed-in fully into the work gear 3 so as to start final forming of the teeth. During this time the work gear 3 cools down to such an extent that its material becomes capable of transmitting torque. The cam 41 (FIG. 2) fully closes the control valve 38 which acts, through the pipeline 36, on the valve 28. The valve 28 causes a pressure increase in the pipelines 30, 35 of the drive 19 of the gear rolling die spindle 4. The cam 42 then releases the control valve 39, and the valve 29 establishes in the pipelines 31, 34 a minimum pressure which is necessary for the drive 9 of the work gear spindle 2 to rotate the work gear 3 (FIG. 6) and the synchronizing member 13. Now the gear rolling die 5 will act as driving member. Accordingly, there is no engagement between the flanks of the synchronizing members 13 and 23 (FIG. 7) and, as the rolled teeth of the work gear are in a playless mesh with the teeth of the gear rolling die 5 (FIG. 8), the final accuracy of the rolled teeth of the work gear 3 will only depend on the accuracy and the quality of the teeth of the gear rolling die 5.

The absence of engagement between the teeth of the synchronizing members 13 and 23 (FIG. 1) of the spindles 2 and 4, respectively, during the final forming of the teeth on the work gear 3 under the action of the teeth of the gear rolling die results in a material reduction in the forces acting on the teeth of the gear rolling die thus substantially prolonging its service life (to at least 7000 of rolled gears). In addition, the quality of rolled gears is also improved.

We claim:

1. A method for hot rolling of bevel gears, comprising infeeding a rotating gear rolling die having a synchronizing member into a rotating work gear having a synchronizing member, said method comprising:

heating said work gear bringing the teeth of said synchronizing members of the gear rolling die and work gear into a meshing relationship;

then, rough forming teeth on the work gear under the action of the teeth of said gear rolling die, the rotating synchronizing member of the work gear acting as a driving member; and finally finishing rolling the rolled teeth of the work gear, by means of said rotating gear rolling die acting as a driving member.

2. A method for hot rolling of bevel gears according to claim 1, wherein the change from the drive by said synchronizing member of the work gear to the drive by said gear rolling die is effected gradually during the infeed of said rotating gear rolling die into said rotating work gear.

3. An apparatus for hot rolling of bevel gears, comprising:

a bed;

a spindle for mounting a work gear having a power drive for its rotation mounted in the bed and having a synchronizing gear mounted thereon;

a spindle mounting a gear rolling die having power drives for its rotation and axial movement, the spindle being installed in said bed above and at an angle with respect to said work gear spindle and having a synchronizing gear mounted thereon for meshing with the synchronizing gear of said work gear spindle;

a power redistribution unit connected to said rotational power drives of said gear rolling die spindle and said work gear spindle for changing from the drive by said synchronizing gear of the work gear to the drive by said gear rolling die.

4. An apparatus for hot rolling of bevel gears according to claim 3, comprising:

said power drives for rotating the gear rolling die and the work gear comprising hydraulic motors having their hydraulic lines;

said power redistribution unit having two controlled valves thereof secured to said bed and mounted in said hydraulic lines of the hydraulic motors of said power drives for operating the power drive rotating the gear rolling die and work gear; two adjustable cams of said power redistribution unit secured to said spindle of the gear rolling die for engaging said controlled valves during axial movement of said spindle of the gear rolling die.

5. The apparatus according to claim 3, wherein said spindle of said gear rolling die comprises a casing mounted for axial movement in said bed, a shaft journalled in bearings within said casing, a driven gear secured to said shaft, a drive consisting of a hydraulic motor secured to said casing, a drive gear secured to the shaft of the drive and meshing with said driven gear.

6. The apparatus according to claim 3, wherein said power redistribution unit comprises a hydraulic pump;

remotely controlled and directional valves associated with said pump by means of pipelines;

said remotely controlled valves being connected to said directional valves, said directional valves being connected to the drive of said work gear spindle and to said rotational drive of the gear rolling die spindle, respectively.

* * * * *